US006932280B2

(12) United States Patent
Crouch

(10) Patent No.: US 6,932,280 B2
(45) Date of Patent: Aug. 23, 2005

(54) ADJUSTABLE NEEDLE FOOT FOR DISPENSING SYSTEM

(75) Inventor: Kenneth C. Crouch, North Andover, MA (US)

(73) Assignee: Speedline Technologies, Inc., Franklin, MA (US)

( * ) Notice: Subject to any disclaimer, the term of this patent is extended or adjusted under 35 U.S.C. 154(b) by 213 days.

(21) Appl. No.: 10/428,250

(22) Filed: May 2, 2003

(65) Prior Publication Data

US 2004/0227010 A1 Nov. 18, 2004

(51) Int. Cl.[7] ..... B05B 15/04; B05C 5/00; B43K 29/00; B67D 5/22; B65B 1/04

(52) U.S. Cl. ..... 239/288.5; 239/288; 118/300; 118/313; 401/193; 222/41; 141/356

(58) Field of Search ..... 239/285, 273, 239/275, 451, 456, 457, 458, 73, 288–288.5, 750–754; 401/193; 141/288, 368, 356, 130, 351, 352; 422/99, 100; 222/41; 118/300, 407

(56) References Cited

U.S. PATENT DOCUMENTS

| | | | | |
|---|---|---|---|---|
| 5,795,390 A | * | 8/1998 | Cavallaro | 118/314 |
| 5,886,494 A | | 3/1999 | Prentice et al. | |
| 5,903,125 A | | 5/1999 | Prentice et al. | |
| 6,007,631 A | | 12/1999 | Prentice et al. | |
| 6,206,964 B1 | | 3/2001 | Purcell et al. | |
| 6,299,078 B1 | * | 10/2001 | Fugere | 239/591 |
| 6,405,902 B2 | * | 6/2002 | Everett | 222/214 |
| 6,547,167 B1 | * | 4/2003 | Fugere | 239/591 |

* cited by examiner

*Primary Examiner*—David A. Scherbel
*Assistant Examiner*—Seth Barney
(74) *Attorney, Agent, or Firm*—Lowrie, Lando & Anastasi, LLP

(57) ABSTRACT

A needle foot assembly for a dispensing system includes a needle nut, a rotatable bearing, a friction brake, and an end piece holding the needle foot. The needle foot assembly attaches the needle to a dispensing head of the dispensing system. Rotation of the bearing alters the orientation of the needle foot and needle. The needle foot is removeably attached to the end piece and can be adjusted with respect to height.

20 Claims, 5 Drawing Sheets

ADJUSTABLE NEEDLE FOOT FOR DISPENSING SYSTEM

BACKGROUND OF THE INVENTION

1. Field of the Invention

The present invention relates to an apparatus and method for controlling the position of a dispensing head for dispensing material onto a substrate in a dispensing system. More particularly, it relates to an apparatus and method for changing the height or position of a foot used to position the needle of a dispensing head.

2. Discussion of Related Art

There are several types of prior art dispensing systems used for dispensing metered amounts of liquid or paste for a variety of applications. One such application is in the assembly of printed circuit boards and integrated circuit chips. In this application, dispensing systems are used in the process of encapsulating integrated circuits with an encapsulating material and in the process of underfilling flip integrated circuit chips with an encapsulant. Prior art dispensing systems are also used for dispensing dots or balls of liquid epoxy or solder paste onto circuit boards and integrated circuits. The liquid epoxy and solder are used to secure components or connect components, respectively, to a circuit board or to an integrated circuit. The dispensing systems described above include those manufactured and distributed by Speedline Technologies, Inc, the assignee of the present invention, under the name CAMALOT.

The dispensing systems described above are typically used in an electronics manufacturing facility in an automated assembly line with other equipment used in a circuit board or integrated circuit manufacturing process. The other equipment in-line with the dispensing systems may include, for example, pick and place machines, which place components on circuit boards, or reflow ovens that are used to heat materials, such as solder paste, dispensed onto the circuit boards or integrated circuits.

In a typical dispensing system, a pump and dispenser assembly is mounted to a moving assembly for moving the pump and dispenser assembly along three mutually orthogonal axes (x, y, z) using servomotors controlled by a computer system or controller. To dispense a dot of liquid on a circuit board at a desired location, the pump and dispenser assembly is moved along the horizontal x and y axes until it is located over the desired location. The pump and dispenser assembly is then lowered along the vertical z axis until the needle of the pump and dispenser assembly is at an appropriate dispensing height over the board. The pump and dispenser assembly dispenses a dot of liquid, is then raised along the z axis, moved along the x and y axes to a new location, and is lowered along the z axis to dispense the next liquid dot.

Dispensing systems can be characterized generally as footed or non-footed systems. Non-footed systems are adapted for applications that do not require contact between the dispense tip and the substrate during dispensing. In non-footed applications, the dispense tip is positioned and suspended above the substrate by a predetermined amount, and the fluid is dropped onto the substrate from above. The height above the substrate must be carefully programmed and calibrated relative to the substrate surface. In footed applications, the tip is provided with a standoff, or "foot", designed to contact the substrate as fluid is delivered by the pump through the tip. The programmed dispense height is set below the surface of the substrate so that the foot reliably contacts the substrate, even as the surface of the substrate varies. Such footed systems allow for tip travel, relative to the pump body, such that the entire weight of the pump does not bear down on the substrate. In many instances, it is important that the distance between the end of the nozzle or dispensing needle and the substrate be precisely controlled. One popular method for controlling this gap is the use of a foot adjacent to the needle. The foot is positioned adjacent the needle of the pump and offset along the z axis to provide the proper distance between the needle and the substrate. When the footed needle is lowered toward the substrate, the foot will contact first and will maintain the needle end at a fixed height above the substrate.

Conventional dispensing systems include a replaceable needle assembly which is attached at the output of the pump with a needle nut. The needle assembly includes a base and a needle extending from the base. The base is shaped to fit within needle nut in a single position. Typically, the base is round with a flat surface. The flat surface on the base engages a tooth on the dispenser. During assembly, the needle is turned to engage the tooth to prevent further rotation of the needle as the needle nut is tightened. A replaceable needle assembly allows different size or length needles to be used with a single dispensing system. Also, needles may wear or break and need to be replaced. With a footed system, the needle foot is formed with the needle as an integral part of the needle assembly. Different needle assemblies have feet at different heights. Thus, in order to change the height of the foot, the needle assembly has to be replaced. In order to accommodate different size needles and different height feet, a large inventory of needle assemblies are required.

Since the foot contacts the substrate during dispensing, it will wear more quickly than the needle. Since precision in the height is necessary for proper dispensing, the entire needle assembly must be replaced when the foot becomes worn. This requires more frequent replacement of footed needle assemblies.

Furthermore, since the needle assembly is in a fixed position relative to the needle nut and dispensing system, the position of the foot cannot be changed. Since the foot is caused to contact the substrate, it is imperative that the foot not be placed in a previous deposit of adhesive. To this end, various methods have been developed to prevent "stepping" in a previous deposit. One method includes the use of a needle with an orientation feature that causes the needle to be mounted in a specific orientation. With the needle orientation fixed within the dispensing system, the position of the needle foot can be determined. However, different applications may require different positions. Thus, footed needles are available with the foot at different fixed positions—0°, 45°, 90°, etc.—relative to the needle. If the dispensing pattern and sequence are known, an appropriate needle may be selected such that the foot is caused to march ahead of the needle position, thereby avoiding its placement in a previous deposit. This approach has the disadvantage that a considerable inventory of various needle sizes, heights, and orientations may be required to support a variety of applications. Also, the pattern has to be carefully designed to accommodate the specific needle and foot.

U.S. Pat. No. 6,299,078 discloses an adapter plate for a footed needle so that it can be mounted in one of eight positions. The adapter plate eliminates the need for multiple needles. The foot may be positioned differently for different application. However, this system still requires careful design of the pattern and sequence to accommodate the selected position. Sometimes, the design of the substrate complicates selection of a position of the foot. Many substrates have features that deviate from a flat plane. For example, the thickness of the traces on a printed circuit board extend above the level of the remainder of the substrate. In such circumstances, if the foot contacts an elevated area, a different needle stand-off height may result. Therefore, a need exists for a dispensing system in which the orientation of the needle and foot can be adjusted as required by the dispensing process. Additionally, if an integral footed needle were rotated to change the orientation, the precise calibration of the dispensing system may be lost. Rotation of the assembly necessarily implies rotation of the needle. Unless the center of rotation is exactly in the center of the needle position, the effectiveness of prior calibrations will be compromised. This effect is exaggerated if the needle were to be bent in any way.

SUMMARY OF THE INVENTION

According to an aspect of the present invention, a dispensing system includes a novel needle nut with a bearing and end piece. A needle foot is removably attached to the end piece so that it extends parallel to the needle assembly positioned in the needle nut. The needle foot is adjustable in height relative to the end piece so that the height of the needle from the substrate may be set. According to another aspect of the invention, the needle foot may be removed and replaced.

According to another aspect of the invention, a friction brake attaches the bearing to the needle nut. The end piece is attached to the bearing. The bearing can be rotated relative to the needle nut, which rotates the end piece and the attached needle foot. The friction brake prevents the unintentional rotation of the bearing. Thus, when it would be desirable to change the position of the needle foot relative to the needle, the bearing can be rotated. The needle foot can be set at any desirable position relative to the needle in order to accommodate different substrate and component configurations.

According to another aspect of the invention, a gear rack is positioned within the dispensing system in order to rotate the bearing. The head of the dispensing system is moved, using the gantry, to the gear rack to engage the bearing. Once the bearing has been engaged, the gantry moves the dispensing head along the gear rack to cause a desired rotation of the bearing and needle foot.

According to another aspect of the invention, a motor and gear drive are attached to the head of the dispensing system. The gear drive engages the bearing. Operation of the motor results in rotation of the bearing and needle foot without the need to move the dispensing head from its position relative to the substrate.

BRIEF DESCRIPTION OF THE DRAWINGS

For a better understanding of the present invention, reference is made to the drawings which are incorporated herein by reference and in which.

DETAILED DESCRIPTION

Figure 1:
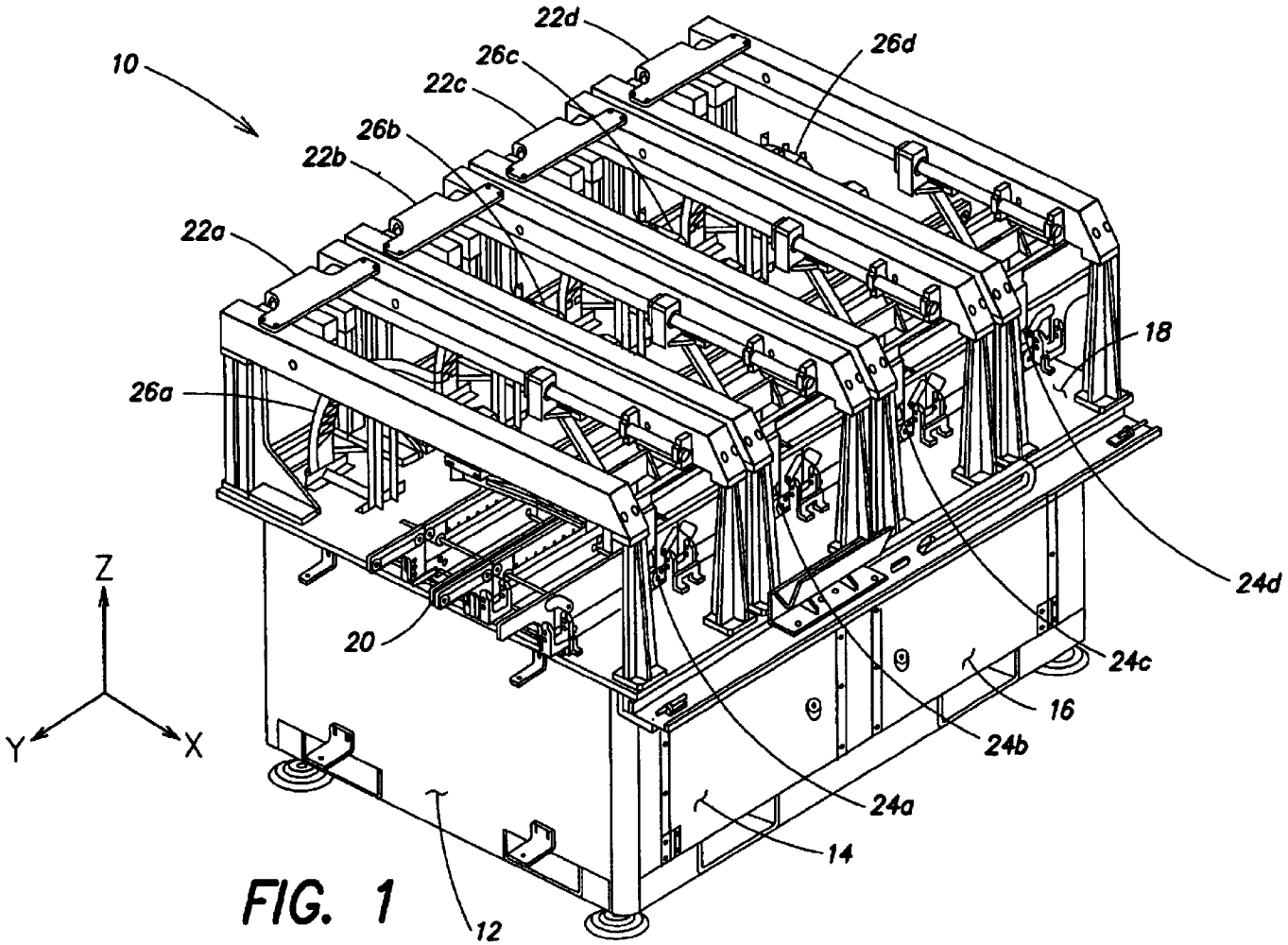
FIG. 1 is a perspective view of a multiple head dispensing system operable in conjunction with the adjustable foot needle of the present invention.

For purposes of illustration, embodiments of the present invention will now be described with reference to dispensing units designed for use with a multiple head dispensing system 10, shown in FIG. 1 and described below and in U.S. Pat. Nos. 6,007,631 and 6,206,964, both of which are assigned to the assignee of the present application, Speedline Technologies, Inc. Those skilled in the art will appreciate that embodiments of the present invention are not limited for use with multiple head dispensing systems, but also may be used in single head applications as well. Furthermore, the present invention may be used in any dispensing system having a needle assembly attached to a dispensing head of the system.

The multiple head dispensing system 10 will now be described with reference to FIG. 1. FIG. 1 shows a perspective view of a multiple head dispensing system 10. The dispensing system 10 includes a lower compartment 12 that is used to house electrical and pneumatic controllers and a primary system controller. Access doors 14 and 16 are mounted on the front of the lower compartment to provide access to the equipment contained therein. The top of the lower compartment forms a work surface 18 on which a dual track conveyor 20 resides. Mounted to the work surface 18 are four x/y gantry systems 22*a*, 22*b*, 22*c* and 22*d*. Each of the gantry systems supports a dispensing head 24*a*, 24*b*, 24*c* and 24*d* which dispenses material onto substrates loaded into the dispensing system using the conveyor system 20, and in addition, in some embodiments of the present invention, each of the gantry systems supports a camera used as part of a vision system alignment and inspection system. The work surface 18 has four holes through which four cable troughs 26*a*, 26*b*, 26*c* and 26*d* pass. Each of the cable troughs are used to run cables from the control electronics and pneumatics in the lower compartment to each of the dispensing heads 24*a*, 24*b*, 24*c* and 24*d*. In one embodiment, the cable troughs are implemented using an E-Chain available from Igus Corporation. The gantry systems 22*a*, 22*b*, 22*c* and 22*d* are substantially identical and in one embodiment are implemented using one of the gantry systems disclosed in either U.S. patent application Ser. No. 08/967,682, entitled "Positioning System", or in U.S. patent application Ser. No. 08/796,236, also entitled "Positioning System", filed Feb. 6, 1997, both of which are incorporated herein by reference.

Figure 2:
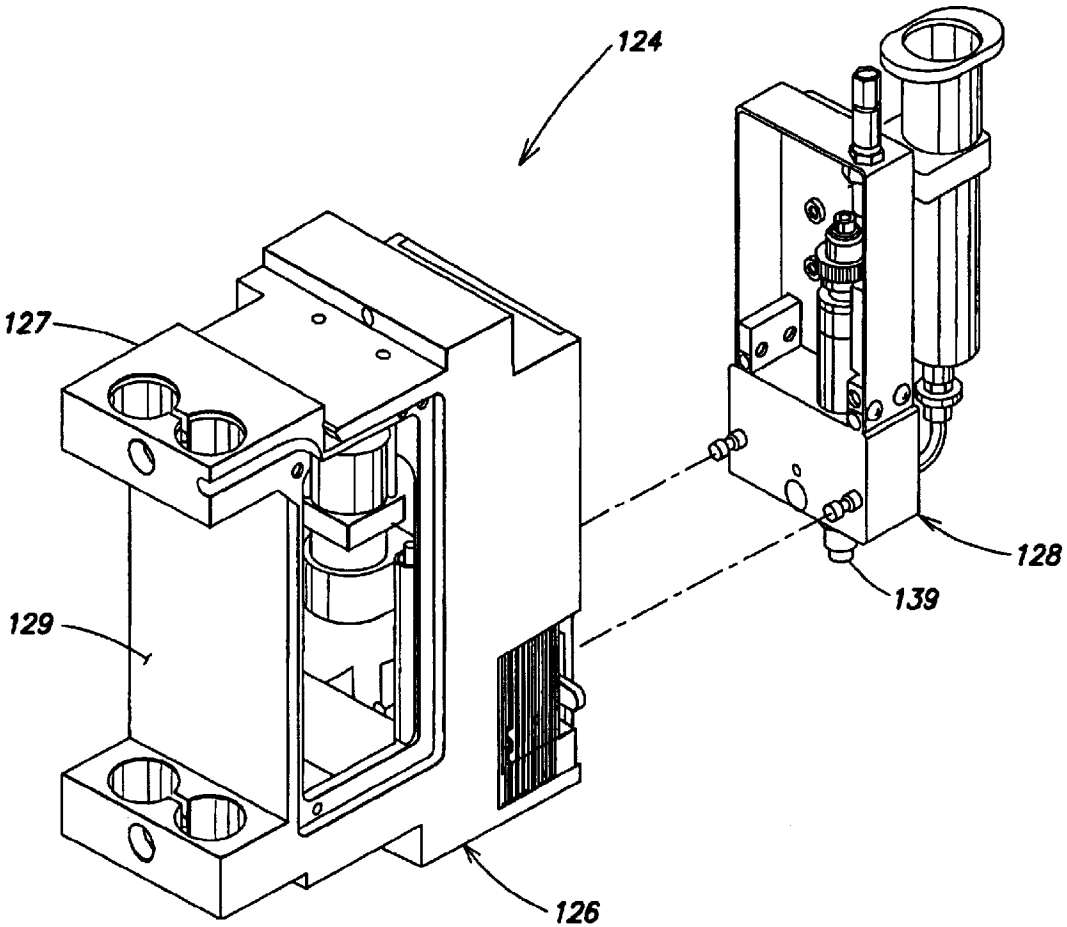
FIG. 2 is a perspective view of a dispensing head that may be used in the dispensing system of FIG. 1.
Figure 3:
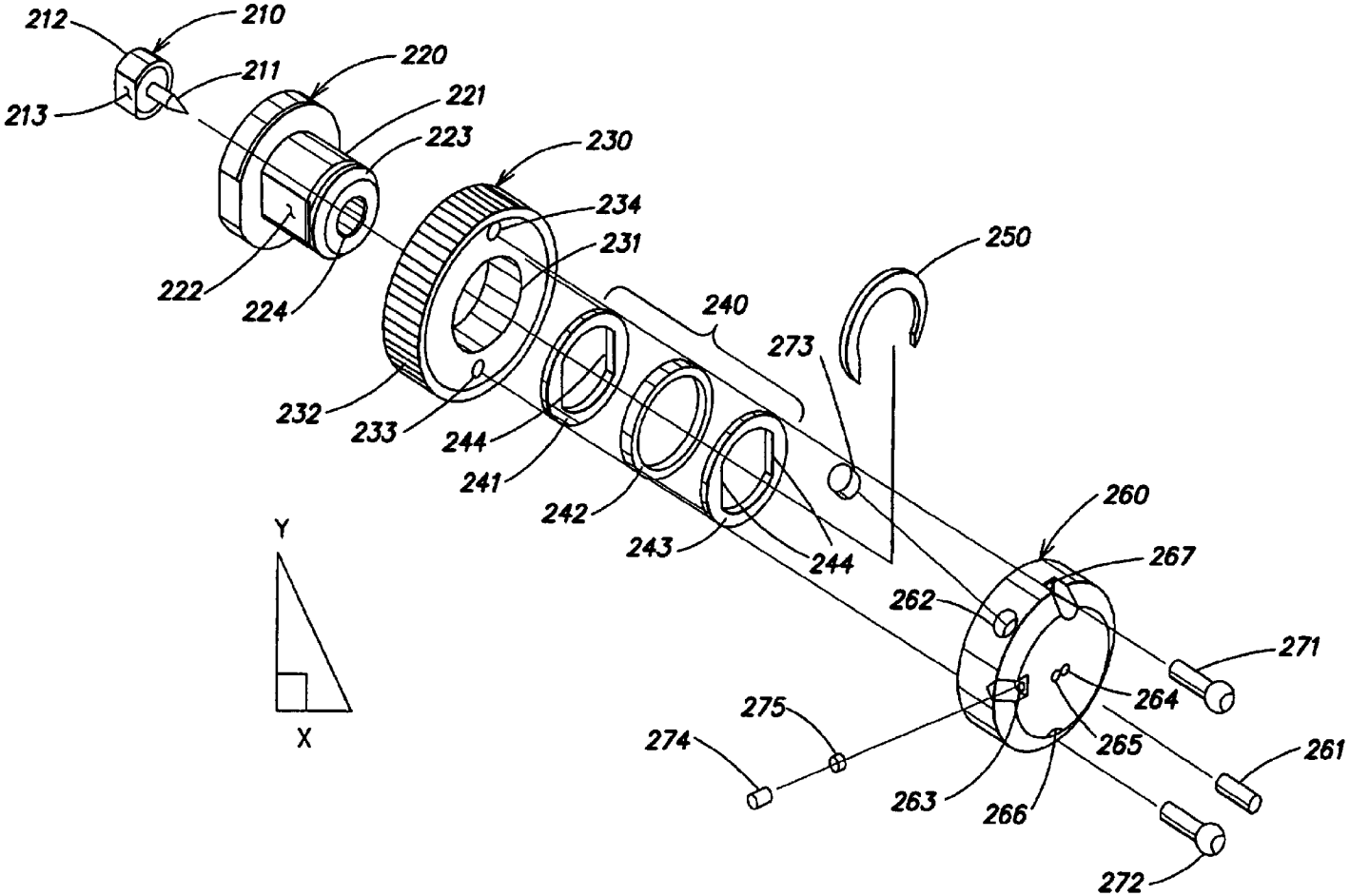
FIG. 3 is an exploded view of an adjustable foot needle in accordance with an embodiment of the present invention.
Figure 4:
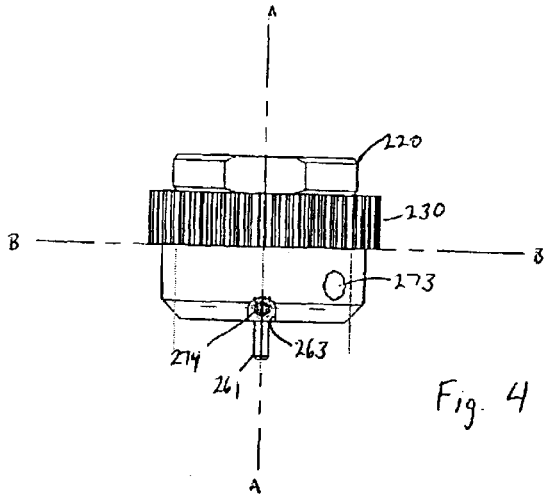
FIG. 4 is a side view of the adjustable foot needle in accordance with an embodiment of the present invention.
Figure 5:
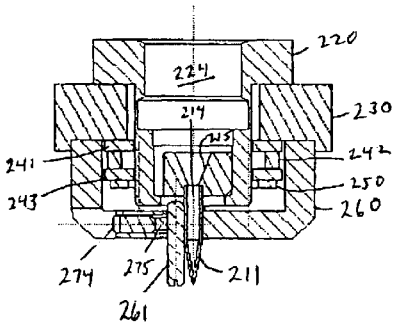
FIG. 5 is a cross sectional view of the adjustable foot needle of FIG. 4 along the line A—A.
Figure 6:
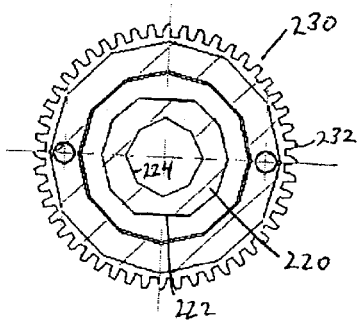
FIG. 6 is a cross section view of the adjustable foot needle of FIG. 4 along the line B—B.

FIG. 2 shows a perspective view of a dispensing head 124 in accordance with one embodiment of the present invention that may be mounted to one of the carriages of the multiple head dispensing system 10. The dispensing head 124 includes a motor unit 126 and a dispensing unit 128. The motor unit has a mounting surface 129 for mounting to one of the carriages, and a yoke feature 127 for connecting to rigid trailing arms. As shown in FIG. 2, the dispensing unit 128 is removable from the motor unit. The dispensing head interacts with the keyed portion 213 on the base 212 of the needle assembly 210 to maintain the positioning of the needle assembly and the needle nut. While the needle assembly 210 may be a conventional design, the needle nut of the present invention has a unique design. In particular, the needle nut 220 includes an extended portion 221 having a reduced diameter which extends along the axis of the central channel. The extended portion 221 is machined to have a keyed portion 222 and a slot 223. As discussed below, the keyed portion 222 and the slot 223 operate with the components of a friction brake of the present invention.

The needle assembly and needle foot of the present invention attach to the output end 139 of the dispensing unit of FIG. 2. The structures of the needle assembly and needle foot are illustrated in FIGS. 3–6. As in a conventional dispensing system, the present invention includes a needle assembly 210 and a needle nut 220 to attach the needle 211 to the output end 139 of the dispensing unit. The needle nut 220 is a threaded collar which mates with the dispensing unit to fix the needle assembly into position. The present invention utilizes a conventional needle assembly 210. The needle assembly includes a needle 211 and a base 212. The base 212 is cylindrical in shape with a flat portion 213. The flat portion mates with a corresponding portion on the needle nut to maintain its orientation with respect to the dispensing unit. The needle assembly has a central channel 214 through which the material to be dispensed can pass. It also includes a tapered portion 215 in the base 212 connected to the central channel 214 to pass the material from the dispensing system to the needle.

According to an embodiment of the present invention, the needle assembly 210 fits into a novel needle nut 220. The needle nut 220 includes a central channel 224 which accommodates the needle assembly. The needle nut 220 also includes a keyed portion which interacts with the keyed portion 213 on the base 212 of the needle assembly 210 to maintain the positioning of the needle assembly and the needle nut. While the needle assembly 210 may be of a conventional design, the needle nut of the present invention has a unique design. In particular, the needle nut 220 includes an extended portion 221 having a reduced diameter which extends along the axis of the central channel. The extended portion 221 is machined to have a keyed portion 222 and a slot 223. As discussed below, the keyed portion 222 and the slot 223 operate with the components of a friction brake of the present invention.

A bearing 230 surrounds the extended portion of the needle nut. The bearing 230 has an inner channel 231 sized to fix around the extended portion of the needle nut so that the bearing 230 can rotate without binding. According to an embodiment of the present invention, the bearing has teeth 232 around the outside surface of the bearing 230. The teeth are spaced every 7.5 degrees around the bearing 230. As discussed below, the teeth 232 are utilized to rotate the bearing in order to change the position of the foot. Alternatively, other structures could be used to provide rotation of the bearing 230. A friction brake 240 maintains the position of the bearing 230 with respect to the needle nut. The friction brake 240 consists of two washers 241, 243 and a spring 242. The washers 241, 243 include keyed portions, such as a flat surface 244, on their inner diameters to match the keyed portion of the needle nut. The spring 242 is placed between the two washers 241, 243. A snap ring 250 is inserted in the slot 223 of the extended portion of the needle nut 220. The extended portion of the needle nut 220 is sized so that the friction brake 240 fits snugly between a surface of the bearing 230 and the snap ring. The friction brake 240 prevent unintentional rotation of the bearing 230. However, the friction brake is not so tight that the bearing cannot be rotated.

An end piece 260 covers the friction brake 240 and attaches to the bearing 230. According to an embodiment of the invention, two screw holes 233, 234 are positioned 180° apart on the surface of the bearing 230. Similarly positioned holes 266, 267 are positioned in the end piece. Screws 271, 272 attach and maintain the alignment of the end piece 260 to the bearing 230. The end piece 260 includes a central hole 264 from which the needle 211 extends. A second hole 265 is located parallel and offset from the central hole 264 to receive the foot 261. According to an embodiment of the invention, the second hole 265 has internal threads and the foot 261 has external threads for engaging the internal threads of the second hole 265. Alternatively, the foot 261 and second hole 265 are not threaded and the foot slides within the hole. The foot 261 is held in place by a set screw 274 inserted into a hole 263 in the side of the end piece 260 extending to the hole 265 for the foot 261. A nylon connector 275 is placed in the hole 263 between the set screw 274 and the foot 261 to prevent damage to the foot. The set screw 274 forces the nylon connector 275 against the foot to retain it in position. A small magnet 273 is placed in a recess 262 in the end piece 260 for an accurate determination of the position of the foot relative to the needle.

The bearing 230 and end piece 260 are concentric to the needle 211. By rotation of the bearing, the orientation of the foot 261 relative to the needle 211 is changed without rotation of the needle 211 itself. Thus, the foot 261 can be moved without changing the calibration of the dispensing system. The needle 211 remains in its original position with respect the dispensing system and various other machine components, such as a machine vision camera. Since the foot 261 is removable from the end piece 260, it can be replaced in the event of accidental damage or eventual wear. Also, the height of the foot 261 can be easily adjusted within the hole 265, by releasing the set screw and moving the foot into or out of the hole. In the embodiment with threads, the height of the foot is easily adjusted by rotating the foot within the hole. Since the foot and needle are formed separately, the materials used for the two parts are not limited and may be selected independently. Furthermore, the adjustable, needle foot structure of the present invention does not add much weight to a conventional dispensing head, which allows rapid cycling of the device and high deposition rates.

Figure 7:
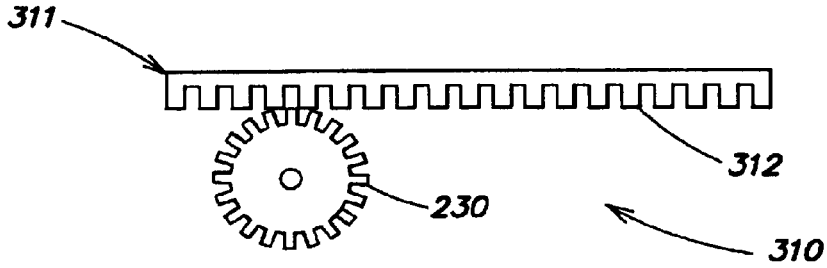
FIG. 7 is a needle positioning mechanism according to a first embodiment of the present invention.

FIG. 7 illustrates a first embodiment of a rotational system 310 for changing the orientation of the foot 261. The rotational system 310 includes an elongated gear rack 311 with a plurality of teeth 312. The teeth 312 are sized to engage the teeth 232 of the bearing. The elongated gear rack 311 could be positioned anywhere inside the dispensing system away from a dispensing area. In order to rotate the bearing 230 and foot 261, the gantry system is used to move the dispensing head into a position engaging the teeth 232 of the bearing 230 with the teeth 312 of the gear rack. Movement of the dispensing head along the axis of the gear rack 311 causes rotation of the bearing 230.

Figure 8:
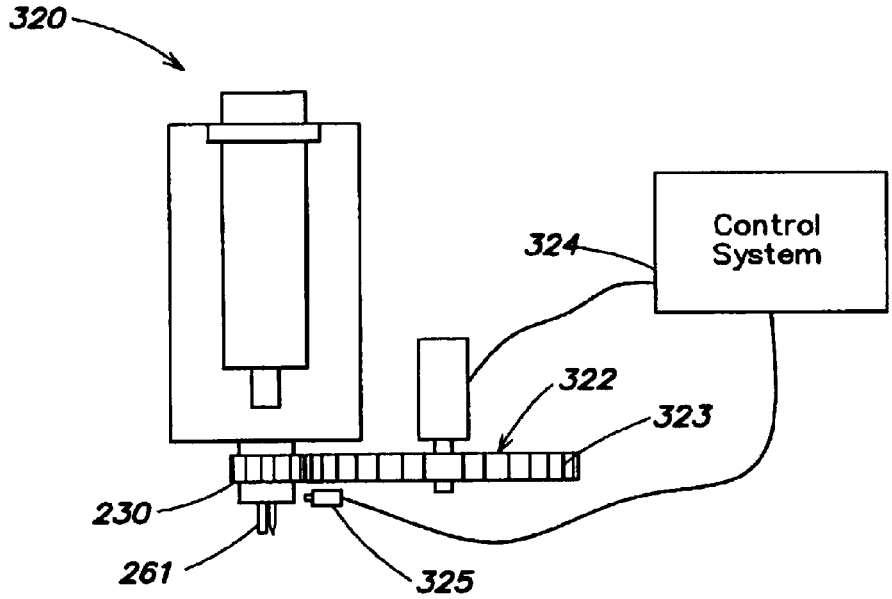
FIG. 8 is a needle positioning mechanism according to a second embodiment of the present invention.

FIG. 8 illustrates a side view of a second embodiment of a rotational system 320 which utilizes a separate motor 321 and gear 322. The gear 322 has teeth 323 sized to engage the teeth 233 of the bearing 230. The rotational system 320 may be positioned in the dispensing system away from a dispensing area. The gantry system is used to move the dispensing head into a position so that the teeth of the bearing 230 engage the teeth 323 of the gear 322. A control system, 324, which may be the main control system of the dispensing system, operates the motor 321 to turn the gear 322 and change the orientation of the foot 261. A magnetic sensor 325 can be used for calibration or control of the rotation. The sensor 325 is used to locate the magnet 273 in the end piece 260. The magnet 273 has a known position with respect to the position of the foot 261. Thus, the position of the foot can be determined during rotation. Preferably, the motor 321 is a stepper motor or similar motor for control of rotation.

Figure 9:
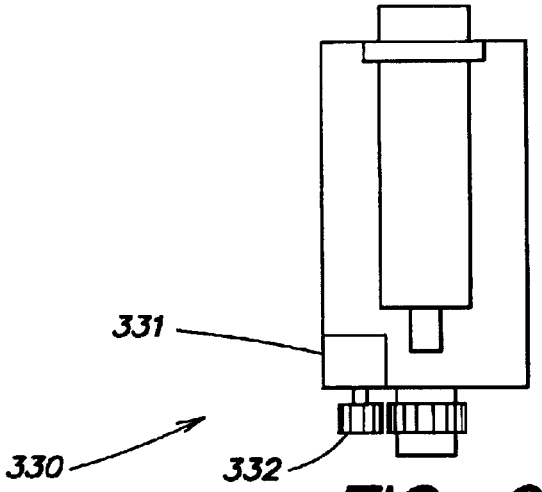
FIG. 9 is a needle positioning mechanism according to a third embodiment of the present invention.

FIG. 9 illustrates a third embodiment of a rotational system 330 which is attached to the dispensing head. The rotational system 330 of the third embodiment also includes a motor 331 and a gear 332. The motor 331 and gear 332 are used in the same manner and the second embodiment of the rotational system 320. However, with this embodiment, the dispensing head does not need to be moved to a specific location within the dispensing system. The motor 331 can be controlled to rotate the bearing 230 and foot 260 at any time and at any location. Of course, other types of rotational systems could be used. For example a ratchet arrangement could be used which index the bearing one or more teeth due to a vertical axis movement of the dispensing head.

Having described at least one embodiment of the present invention, modifications, adaptations and improvements will be readily apparent to those of ordinary skill in the art. Such modifications, adaptations and improvements are considered part of the present invention which is only limited by the claims attached hereto.

What is claimed is:

1. An adjustable needle foot assembly for a dispensing system comprising:

a needle having a dispensing axis;

a needle nut attaching the needle to a dispensing head in the dispensing system;

a bearing attached to the needle nut such that it is rotatable about the dispensing axis; and a foot attached to and rotatable with the bearing.

2. The adjustable needle foot assembly of claim 1, further comprising a brake for impeding rotation of the bearing about the dispensing axis.

3. The adjustable needle foot assembly of claim 2, wherein the brake is a friction brake.

4. The adjustable needle foot assembly of claim 1, wherein the foot is removeably attached to the bearing.

5. The adjustable needle foot assembly of claim 1, further comprising:

means for adjusting the relative height of the foot with respect to the needle.

6. The adjustable needle foot assembly of claim 1, further comprising:

an end piece attached to the bearing, wherein the end piece includes:

a hole substantially parallel to the dispensing axis for receiving the foot; and a set screw for retaining the foot within the hole.

7. The adjustable needle foot assembly of claim 6, wherein the hole includes internal threads and wherein at least a portion of the foot includes external threads for mating with the internal threads of the hole.

8. The adjustable needle foot assembly of claim 1, wherein the bearing includes a plurality of teeth on an exterior edge of the bearing.

9. A dispensing system including:

a dispensing head;

a gantry system for moving the dispensing head in three dimensions;

a needle having a dispensing axis;

a needle nut attaching the needle to the dispensing head in the dispensing system;

a bearing attached to the needle nut such that it is rotatable about the dispensing axis; and a foot attached to and rotatable with the bearing.

10. The dispensing system of claim 9, further comprising a brake for impeding rotation of the bearing about the dispensing axis.

11. The dispensing system of claim 10, wherein the brake is a friction brake.

12. The dispensing system of claim 9, further comprising a rotation system for rotating the bearing about the dispensing axis.

13. The dispensing system of claim 12, wherein the bearing includes a plurality of teeth about an exterior edge of the bearing; and the rotation system includes a gear rack for engaging the plurality of teeth, such that movement of the dispensing head along the gear rack rotates the bearing.

14. The dispensing system of claim 12, wherein the bearing includes a plurality of teeth about an exterior edge of the bearing; and the rotation system includes:

a gear for engaging the plurality of teeth; and a motor for rotating the gear and the bearing.

15. The dispensing system of claim 14, wherein the rotation system is attached to the dispensing head.

16. The dispensing system of claim 12, further comprising a sensor for determining the orientation of the needle foot and the needle.

17. The dispensing system of claim 16, wherein the sensor includes a magnetic sensor.

18. A method for adjusting a position of a foot used to position a needle of a dispensing head of a dispensing system, the method comprising:

loading a substrate into the dispensing system, the substrate having a top surface onto which material is to be dispensed;

positioning the needle over the top surface of the substrate;

adjusting the position of the foot with respect to the needle;

engaging the substrate with the foot; and dispensing a drop of material onto the substrate.

19. The method of claim 18, wherein the step of adjusting the position of the foot includes rotating the foot about the needle.

20. The method of claim 18, further comprising adjusting a length of the foot.

* * * * *